US010660818B1

(12) United States Patent
Kramer

(10) Patent No.: US 10,660,818 B1
(45) Date of Patent: May 26, 2020

(54) ROLLER SYSTEM FOR USE IN A MUSCLE MASSAGER

(71) Applicant: Innovation Ethos, LLC, San Diego, CA (US)

(72) Inventor: Marcus Kramer, El Cajon, CA (US)

(73) Assignee: INNOVATION ETHOS, LLC, San Diego, CA (US)

( * ) Notice: Subject to any disclaimer, the term of this patent is extended or adjusted under 35 U.S.C. 154(b) by 0 days.

(21) Appl. No.: 16/297,444

(22) Filed: Mar. 8, 2019

(51) Int. Cl.
*A61H 15/00* (2006.01)

(52) U.S. Cl.
CPC ..... *A61H 15/00* (2013.01); *A61H 2015/0014* (2013.01); *A61H 2201/0107* (2013.01); *A61H 2201/169* (2013.01)

(58) Field of Classification Search
CPC .. A61H 15/00; A61H 2015/0014–0021; A61H 2201/169; A61H 2201/0107; Y10T 292/23; Y10T 292/28; Y10T 292/285; Y10T 292/286; Y10T 292/288; Y10T 292/289; Y10T 292/291; Y10T 292/293; Y10T 292/2934; Y10T 292/294; Y10T 292/296; Y10T 292/297; Y10T 292/299; Y10T 292/304; Y10T 292/305; Y10T 292/34; Y10T 292/37; Y10T 292/373; Y10T 292/379; Y10T 292/388; Y10T 292/391; Y10T 292/394; Y10T 292/397; Y10T 292/65; Y10T 292/67; E05C 19/003; E05C 17/30; F16B 7/10; F16B 7/105; F16B 7/14
See application file for complete search history.

(56) References Cited

U.S. PATENT DOCUMENTS

| | | | | |
|---|---|---|---|---|
| 8,756,963 | B2 * | 6/2014 | Le | E05C 1/14 292/169 |
| 2012/0028765 | A1 * | 2/2012 | Morin | A61H 15/00 482/91 |
| 2013/0066245 | A1 * | 3/2013 | Dagan | A61H 7/003 601/118 |
| 2016/0058656 | A1 * | 3/2016 | Harvel | A61H 15/0092 601/122 |
| 2018/0142832 | A1 * | 5/2018 | Inouye | F16M 13/022 |

* cited by examiner

*Primary Examiner* — Quang D Thanh
*Assistant Examiner* — Jacqueline M Pinderski
(74) *Attorney, Agent, or Firm* — Manuel de la Cerra

(57) ABSTRACT

A roller system is disclosed that includes a roller axle with a longitudinal axis that houses at least a portion of a latch assembly. The latch assembly includes a latch with an exposed portion that moves substantially orthogonal to the longitudinal axis. The system also has a roller assembly that removably fits around the roller axle and has a latch catch. The system has two configurations: (1) a locked configuration, where the exposed portion of the latch obstructs the latch catch from sliding, thereby locking the roller assembly onto the roller axle; and (2) an unlocked configuration, where the exposed portion of the latch is moved towards the longitudinal axis, thereby allowing the latch catch to slide past, separating the roller assembly from the roller axle.

18 Claims, 11 Drawing Sheets

ROLLER SYSTEM FOR USE IN A MUSCLE MASSAGER

1.0 TECHNICAL FIELD

The present invention relates to a roller system to be used with a muscle massager that provides effective, therapeutic massage to a user's muscles.

2.0 RELATED APPLICATIONS

None.

3.0 BACKGROUND

The inventor of the present application has previously disclosed various massage roller designs in U.S. Patent Application 62/210,950 entitled Adjustable Muscle Roller and filed on Aug. 27, 2015, U.S. Patent Application 62/376,882 entitled Dual Muscle Roller and filed on Aug. 18, 2016, U.S. Pat. No. 10,039,690 entitled "Dual Muscle Roller" and issued on Aug. 7, 2018, U.S. Pat. D833634 entitled "Dual Muscle Roller" and issued on Nov. 18, 2018, and U.S. patent application Ser. No. 29/637,087 entitled "Dual Muscle Roller" and filed on Feb. 13, 2018. Each of these references is incorporated in their entirety herein by reference.

The present invention provides for improvements to muscle roller designs and is intended to allow for easy replacement and maintenance of the rollers, resulting in a more user-friendly, versatile, and economical design.

Of the competing muscle roller products on the market that use one or more axle-mounted rollers, very few of them have any mechanism to enable users to replace the rollers. The competing muscle roller products that do enable users to replace their rollers most often require tools or other time-consuming and difficult mechanisms in order to perform the replacements.

Enabling easy roller replacement allows the user to select from a variety of different rollers that may suit different needs. One roller may have a firm outer surface for aggressive massage therapy, and another may have a thick or soft surface to treat a sensitive, injured or sore muscle. Another may have surface contours to perform different types of physical therapy or massage therapy on specific muscles or other tissues. With the quick and simple roller replacement mechanism described in the present invention, users are able to switch roller types within an individual use session multiple times without the extra time or tools required for other replacement mechanisms. The present invention enables the removal and replacement of a roller using only one hand. A user can remove and replace a pair of rollers with a different pair in less than five seconds.

Removing the rollers from the frame may reduce the overall dimensions of the product, so that it may fit into a smaller container for shipping and for user transport. Enabling simple roller replacements also allows users to replace an individual damaged or defective roller without requiring technical support or requiring a complete product replacement.

4.0 SUMMARY

A roller system is disclosed that includes a roller axle with a longitudinal axis that houses at least a portion of a latch assembly. The latch assembly includes a latch with an exposed portion that moves substantially orthogonal to the longitudinal axis. The system also has a roller assembly that removably fits around the roller axle and has a latch catch. The system has two configurations: (1) a locked configuration, where the exposed portion of the latch obstructs the latch catch from sliding, thereby locking the roller assembly onto the roller axle; and (2) an unlocked configuration, where the exposed portion of the latch is moved towards the longitudinal axis, thereby allowing the latch catch to slide past to separate the roller assembly from the roller axle.

The latch assembly may also have a latch spring biased to maintain a portion of the latch exposed. The latch may be shaped as a ramp, such that when the roller assembly is mounted to the roller axle, the roller assembly travels along the ramp shape and retracts the exposed portion of the latch). The latch assembly may be a cartridge.

The latch assembly may also have a button with a button stem. The button moves substantially parallel to the longitudinal axis. The latch further includes a latch ramp that contacts the button stem. During the unlocked configuration, the button is moved substantially parallel to the longitudinal axis, causing the button stem to travel along the latch ramp, thus retracting the exposed portion of the latch. The latch assembly may include a button spring biased to maintain the button in the locked configuration in the absence of an actuation force on the button.

The roller assembly may have an inner tube concentric with a roller body, and may also include a bearing in between the inner tube and the roller body such that the roller body turns independently of the inner tube. The roller assembly may also have an extended collar, with the latch catch on the edge of the extended collar. The roller assembly may also have an extended collar with an extended collar hole, where the latch catch is on the edge of the extended collar hole.

The roller axle may have a roller stop. The roller axle may also have an opening through which the exposed portion of the latch travels.

The foregoing summary is illustrative only and is not meant to be exhaustive. Other aspects, objects, and advantages of this invention will be apparent to those of skill in the art upon reviewing the drawings, the disclosure, and the appended claims.

5.0 BRIEF DESCRIPTION OF THE DRAWINGS

Various aspects of certain example embodiments can be better understood with reference to the following figures. The components shown in the figures are not necessarily to scale, emphasis instead being placed on clearly illustrating example aspects and features. In the figures, like reference numerals designate corresponding parts throughout the different views and embodiments. Certain components and details may be omitted from the figures to improve clarity.

6.0 DETAILED DESCRIPTION OF EXAMPLE EMBODIMENTS

Figure 1A:
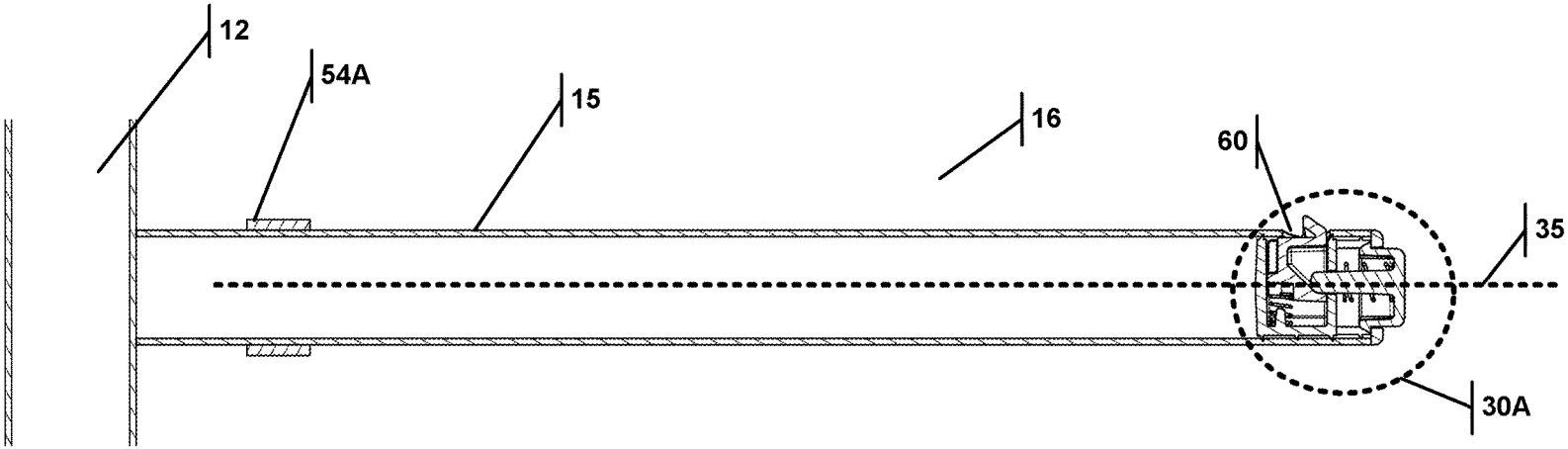
FIG. 1A is a cross-sectional view of an axle assembly, which is comprised of an axle, a roller stop, and a latch assembly.

Following is a written description illustrating various aspects of non-limiting example embodiments. These examples are provided to enable a person of ordinary skill in the art to practice the full scope of the invention, including different examples, without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms, unless noted otherwise. Similarly, various steps of the methods shown and described herein are not necessarily performed in the order indicated, or performed at all, in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection, unless otherwise noted.

Advantageously, the device and method disclosed herein provide an improved device that allows a user to apply massage to their muscles effectively. The attached figures disclose various embodiments of the innovation that provide a device that a user can use to provide effective and therapeutic massage to their muscles. The following list of example features corresponds with the included figures and is provided for ease of reference, where like reference numerals designate corresponding features throughout the specification and figures:

Roller System 10
Roller Device Structure 12
Roller axle 15
Roller Axle Assembly 16
Roller Assembly 18A, 18B, 18C
Roller body 20
Roller Foam 25
Latch Assembly 30A, 30B
Latch Assembly Cartridge 31A, 31B
Latch Assembly Cartridge Housing 32A, 32B
Cartridge Housing Partition 33
Longitudinal Axis 35
Button 40
Button Retention Tab 41
Button Stem 45
Latch 50
Exposed Portion of Latch 51
Latch Catch 52
Inner Tube 53
Extended Collar 53B, 53C
Bearings 54
Roller Stop 54A
Latch Ramp 55
Extended Collar Hole 56
Roller axle opening 60
Button Spring 65
Button Spring Bias Force 67
Latch Spring 70A, 70B
Latch Spring Bias Force 72
Locked Configuration 75
Unlocked Configuration 80
Lateral movement (Actuation) of Button 85
Lateral (orthogonal) movement of latch 90
Slide Direction of Roller Assembly 95
Lateral movement (Actuation) of latch 100

The features described herein may be used with the massage rollers previously disclosed by the inventor in U.S. Patent Application 62/210,950 entitled Adjustable Muscle Roller and filed on Aug. 27, 2015, U.S. Patent Application 62/376,882 entitled Dual Muscle Roller and filed on Aug.

18, 2016, U.S. Pat. No. 10,039,690 entitled "Dual Muscle Roller" and issued on Aug. 7, 2018, U.S. Pat. D833634 entitled "Dual Muscle Roller" and issued on Nov. 18, 2018, and U.S. patent application Ser. No. 29/637,087 entitled "Dual Muscle Roller" and filed on Feb. 13, 2018. Each of these references is incorporated in their entirety herein by reference.

FIGS. 1A-1D illustrate embodiments of a roller axle assembly 16. In one embodiment in FIGS. 1A-1D, a roller axle 15 is connected to the rest of the muscle-roller device structure 12 on one end, but is not connected to any substantial structure on its second, open end. The roller axle 15 and the rest of the roller device structure 12 may be constructed of metal or plastic tubing or another rigid material, including but not limited to wood, fiberglass, or solid plastic.

In one embodiment, the roller axle 15 contains a roller stop 54A along its length near the connection point between the roller axle 15 and the roller device structure 12. The roller stop 54A is a collar that is fastened partially or completely around the circumference of the roller axle 15 by one or more fasteners, adhesive, friction, or welding. In another embodiment, the roller stop 54A is any mechanical feature or component that alters the outer diameter of the roller axle 15 at a specific position along its longitudinal axis 35. In another embodiment, the roller axle 15 does not contain a roller stop 54A.

In FIGS. 1A-1D, the roller axle 15 has a roller axle opening 60 near the open end of the roller axle 15. The roller axle opening 60 may be a hole passing through at least one wall of the roller axle 15 structure, with the hole axis substantially orthogonal to the longitudinal axis 35 of the roller axle 15.

Figure 1B:
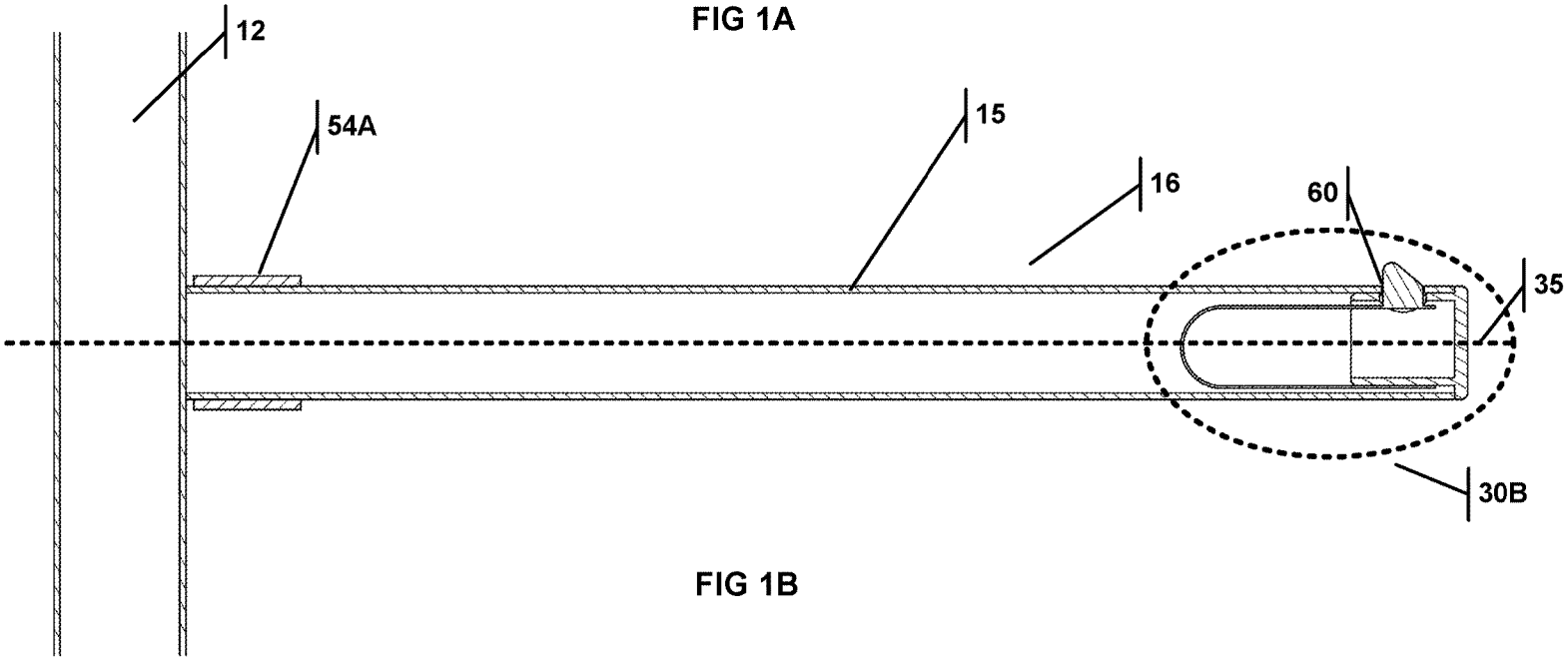
FIG. 1B is a side cross-sectional view of the axle assembly with an alternate latch assembly.
Figure 1C:
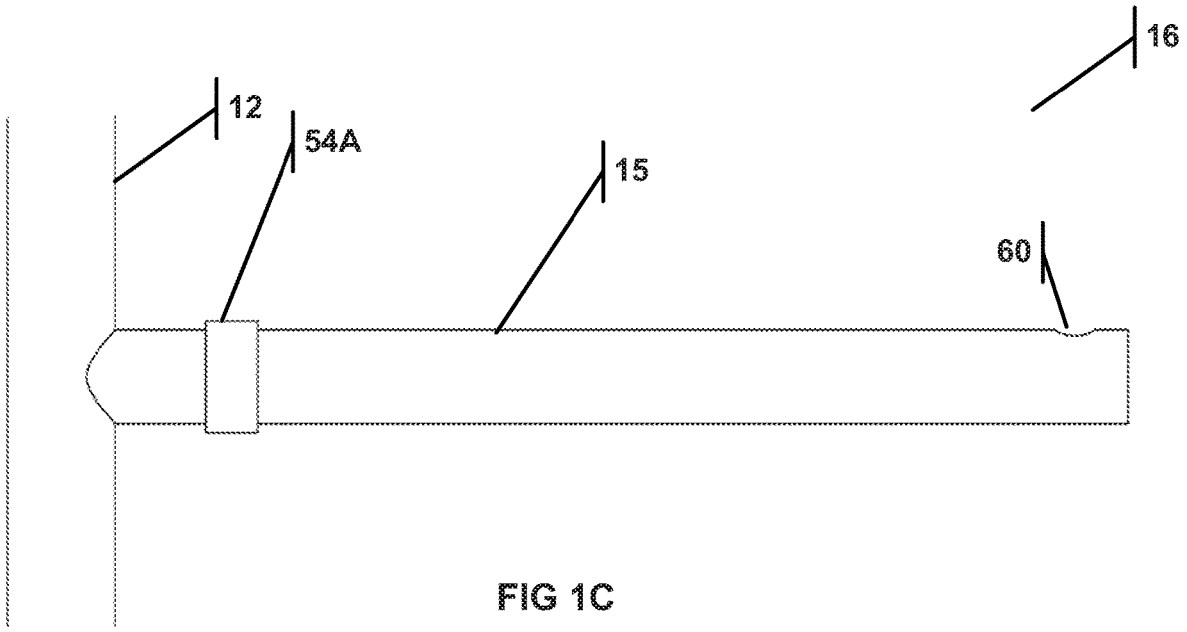
FIG. 1C is a side view of the axle assembly without the latch assembly.
Figure 1D:
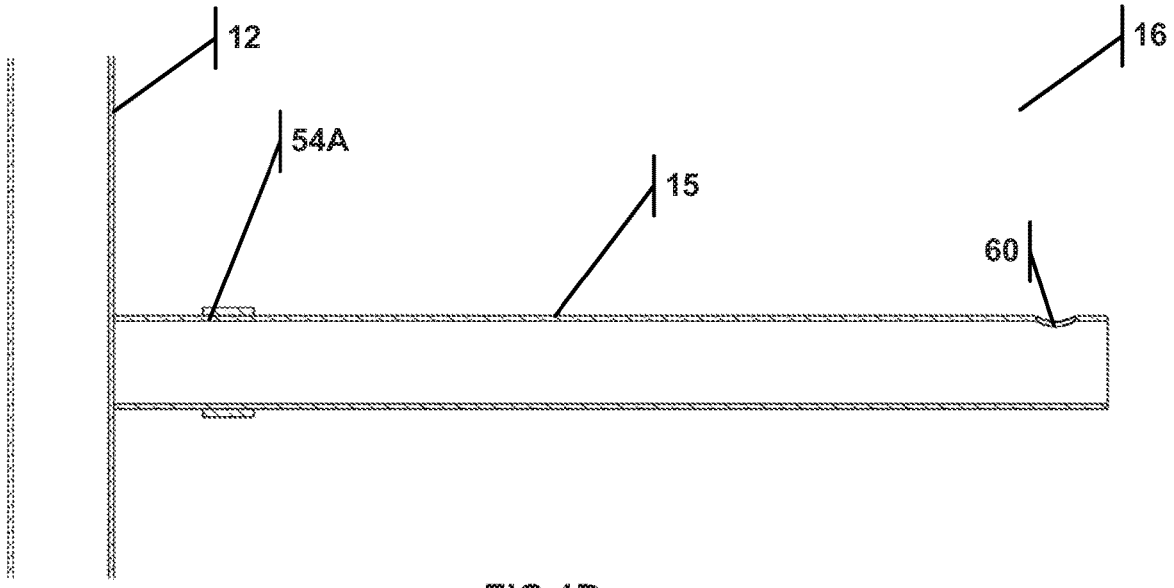
FIG. 1D is a cross-sectional side view of the axle assembly without the latch assembly.

FIGS. 1A-1B show a complete roller axle assembly 16, which includes the roller axle 15, the roller stop 54A, the roller axle opening 60, as well as a latch assembly 30A, 30B, installed partially into its open end. FIG. 1A shows one embodiment using roller latch assembly 30A, and FIG. 1B shows another embodiment using roller latch assembly 30B.

FIGS. 2A-2F illustrate embodiments of a roller assembly 18A, 18B, 18C. The roller assembly comprises an inner tube 53 with a latch catch 52 at one or both ends, a roller body 20 surrounding and concentric with the inner tube 53, one or more bearings 54 between the inner tube 53 and roller body 20, and roller foam 25 covering some or all of the outer surface of the roller body 20. The inner tube 53 is a hollow rigid tube made from plastic, metal, fiberglass, wood, or the like. In FIG. 18A, the inner tube 53 is a cylindrical tube with a flange formed into each end of the tube, where the flange acts as a latch catch 52. Alternatively, any feature such as a rib, a rounded edge, or a straight cut edge that is at one or both ends of the inner tube 53 may act as the latch catch 52.

In FIGS. 2A-2F, the inner tube 53 connects to the roller body 20 through a pair of bearings 54. The bearings 54 enable the roller body 20 to rotate independently of the inner tube 53. The bearings 54 may be ball bearings, needle bearings, plain bearings, bushings, or the like. One or more bearings 54 or bushings may be used to connect the inner tube 53 with the roller body 20. Alternatively the roller assembly 18A may not include an inner tube 53 or bearings 54, and the roller body 20 may simply rotate about the roller axle 15, with the proximal edge of the roller body 20 acting as the latch catch 52. The roller body 20 may be mechanically prevented from rotating about the roller axle 15 with a locking mechanism such as a pin or interlocking teeth.

The roller body 20 may be constructed of a rigid material such as metal, plastic, fiberglass, wood, or the like. In FIGS. 2A-2F, the roller body 20 is covered on its outer surface with a layer of roller foam 25. The roller foam 25 may be one or more pliable materials such as rubber, foam, leather, textile material, or the like. The roller foam 25 may have a smooth outer surface, or it may have texture, contours, or other uneven features. Alternatively, the roller body 20 may not contain any covering on its outer surface: the outer surface of the roller body 20 may be smooth, or it may have texture, contours, or other uneven features.

Figures 2A, 2B, 2C:
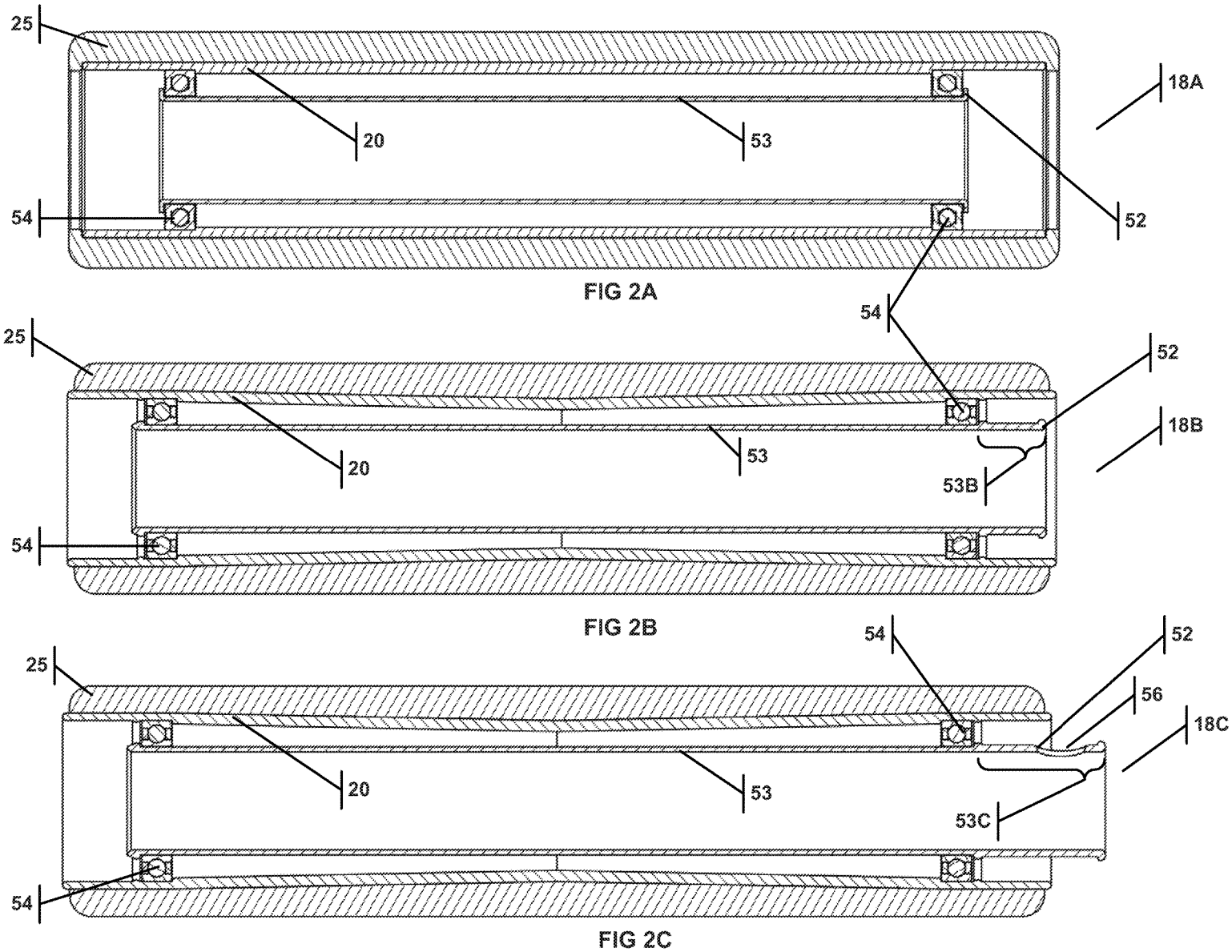
FIG. 2A is a cross-sectional side view of a roller assembly.
FIG. 2B is a cross-sectional side view of another embodiment of the roller assembly, with an extended collar.
FIG. 2C is a cross-sectional side view of another embodiment of the roller assembly, with an extended collar which has a hole.
Figure 2D:
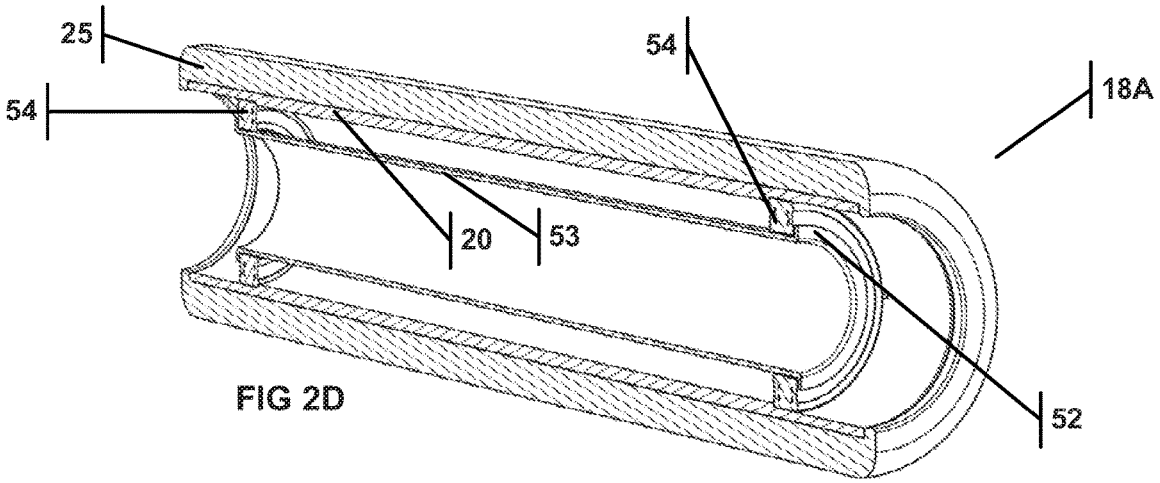
FIG. 2D is a cross-sectional perspective view of the roller assembly of FIG. 2A.
Figure 2E:
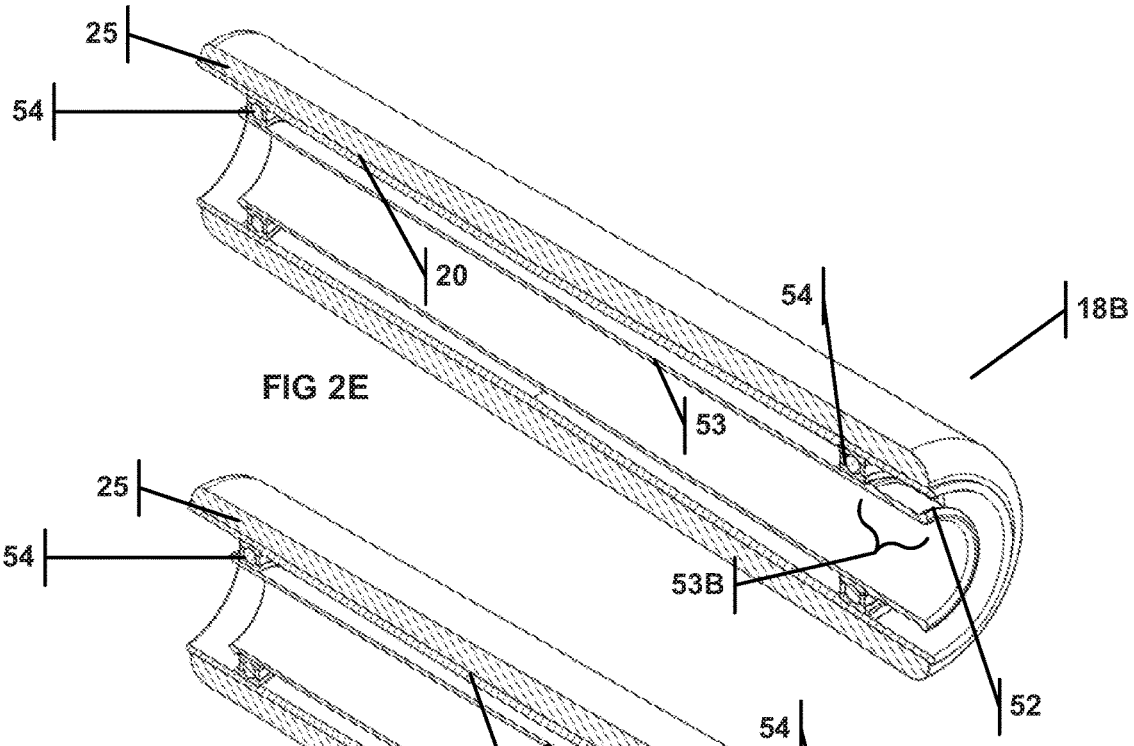
FIG. 2E is a cross-sectional perspective view of the roller assembly of FIG. 2B.
Figure 2F:
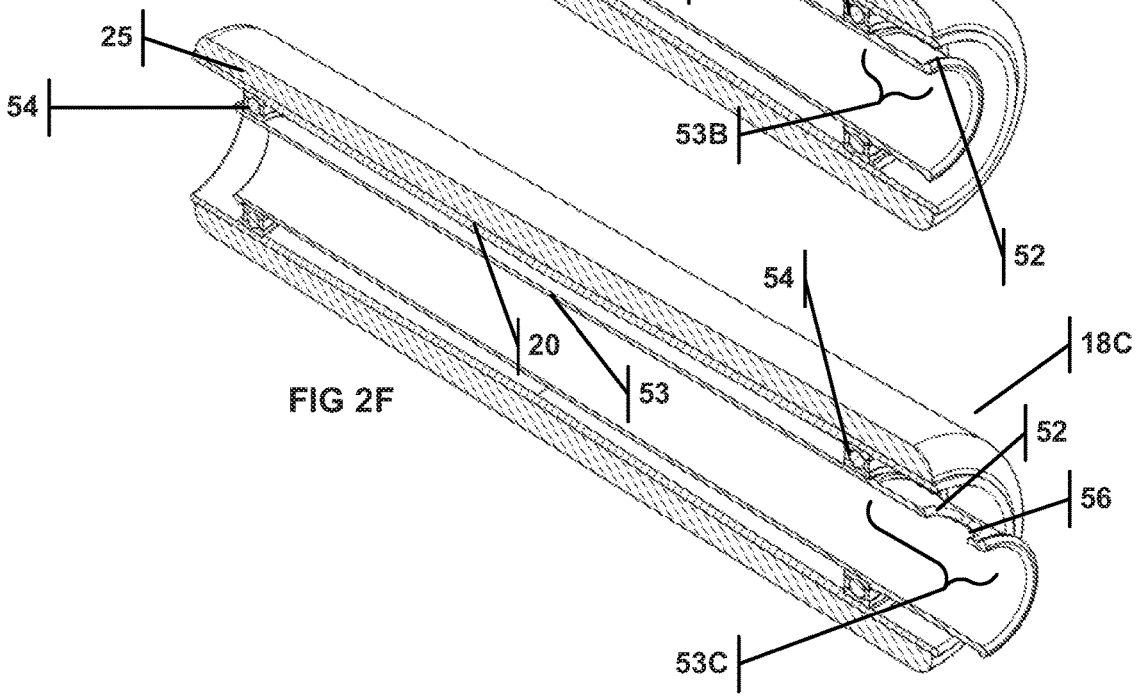
FIG. 2F is a cross-sectional perspective view of the roller assembly of FIG. 2C.

The roller assemblies 18A, 18B, 18C shown in FIGS. 2A-2F illustrate some minor differences in their structures, but the primary variation is the presence of an extended collar 53B in roller assembly 18B shown in FIGS. 2B, 2E, and the extended collar 53C with an extended collar hole 56 in the roller assembly 18C shown in FIGS. 2C, 2F.

The extended collar 53B in roller assembly 18B in FIGS. 2B, 2E extends the length of the inner tube on one end. This extension moves the latch catch 52 to the proximal edge of the extended collar 53B and closer to the outer edge of the roller body 20, where it may be more accessible for the user to activate a release mechanism, particularly using only one hand. The extended collar 53B may be a separate component that attaches to the inner tube 53. The extended collar 53B may be on both ends of the inner tube 53 instead of a single end, which allows the roller assembly 18B to be mounted to the roller axle 15 in either orientation. The extended collar 53B may extend past one or both ends of the roller body 20 and acts as a roller stop against the roller device structure 12, so that the separate roller stop 54A component is not needed to hold the roller assembly 18B in place on the roller axle 15 and to prevent the roller body 20 from rubbing against the device structure 12.

The extended collar 53C in roller assembly 18C in FIGS. 2C, 2F extends the length of the inner tube 53 on one end. This extension includes the extended collar hole 56 that passes through the wall of the collar near the end of the collar. The edge of the extended collar hole 56 acts as the latch catch 52 in this embodiment. This extension moves the latch catch 52 closer to the outer edge of the roller body 20, where it may be more accessible for the user to activate a release mechanism, particularly using only one hand. The extended collar 53C may be a separate component that attaches to the inner tube 53. The extended collar 53C may be on both ends of the inner tube 53, which allows the roller assembly 18C to be mounted to the roller axle 15 in either orientation. The extended collar 53C may extend past one or both ends of the roller body 20 and may act as a roller stop against the roller device structure 12, so that the separate roller stop 54A component is not needed to hold the roller assembly 18C in place on the roller axle 15 and to prevent the roller body 20 from rubbing against the device structure 12. The extended collar 53C may have multiple extended collar holes 56 along its circumference.

FIGS. 3A-3D illustrate a latch assembly 30A. The latch assembly is comprised of a latch assembly cartridge 31A mounted to the open end of the roller axle 15. The latch assembly cartridge 31A is comprised of a latch assembly cartridge housing 32A, which houses a latch 50, a latch spring 70A, a button 40, and a button spring 65. The button 40, latch 50, latch assembly cartridge housing 32A may be made out of plastic, metal, fiberglass, wood, or the like. In FIGS. 3A-3D, the latch assembly cartridge housing 32A has tapered ribs that allow the housing to be pressed into the open end of the roller axle 15. The ribs are constructed to flex in one direction as the housing is inserted, but they grip the inner wall of the roller axle 15 if force is applied to try to pull the housing out of the roller axle tube 15. In another embodiment, the housing is fastened to the roller axle 15 by fasteners, adhesive, friction, or the like.

The button 40 protrudes out of the end of the latch assembly cartridge housing 32A, and is constructed to move substantially parallel to the longitudinal axis 35 of the roller axle 15. The bottom 40 may be flush or may be recessed from the edge of the latch assembly cartridge housing 32A. The button has button retention tabs 41, which are barbed tabs that prevent the button from coming out of the latch assembly cartridge housing 32A. The button 40 has a cylindrical button stem 45 on its inner surface that faces the inside of the housing. The button stem 45 passes through an opening in a partition 33 inside of the latch assembly cartridge housing 32A. A button spring 65 surrounds the button stem 45 and is a compression spring that applies force between the button 40 and the partition 33 in the housing. The button retention tabs 41 prevent the button spring 65 from forcing the button 40 to be ejected from the latch assembly cartridge housing 32A. When a user presses and releases the button 40, the button spring 65 applies a button-spring bias force 67 to the button 40 in order to return the button to its original position, resting against the button retention tabs 41.

The button stem 45 protrudes into a second compartment inside of the latch assembly cartridge housing 32A. This second compartment is on the opposite side of the partition 33 from the button 40. This second compartment houses a latch 50 that is constructed to move substantially orthogonal to the longitudinal axis 35. The latch 50 has an inner portion that includes a latch ramp 55, and it also has an exposed portion of the latch 51 at its top. The exposed portion of the latch 51 has a sloped side facing the button 40 and the open end of the roller axle 15. The tip of the button stem 45 contacts the latch ramp 55. A latch spring 70A is a compression spring that is between the bottom of the latch 50 and the latch assembly cartridge housing 32A. The latch spring 70A applies an upward latch-spring bias force 72 to the latch 50. The tip of the button stem 45 prevents the latch 50 from being ejected from the latch assembly cartridge housing 32A by interlocking with the lip at the base of the latch ramp 55.

Figure 3A:
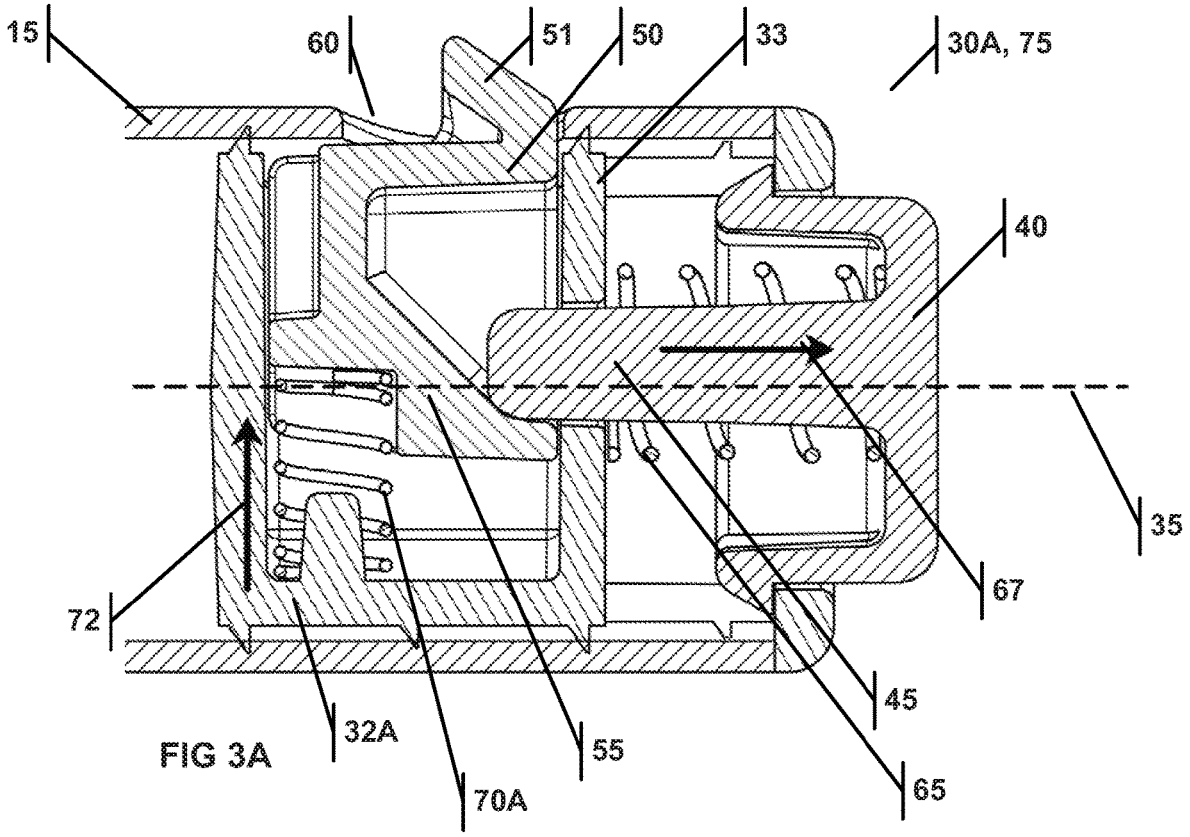
FIG. 3A is a cross-sectional view of a latch assembly in the locked configuration.

In the locked configuration 75 shown in FIG. 3A, the button 40 is not pressed, and the exposed portion of the latch 51 extends upward outside of the latch assembly cartridge housing 32A and through the roller axle opening 60.

Figure 3B:
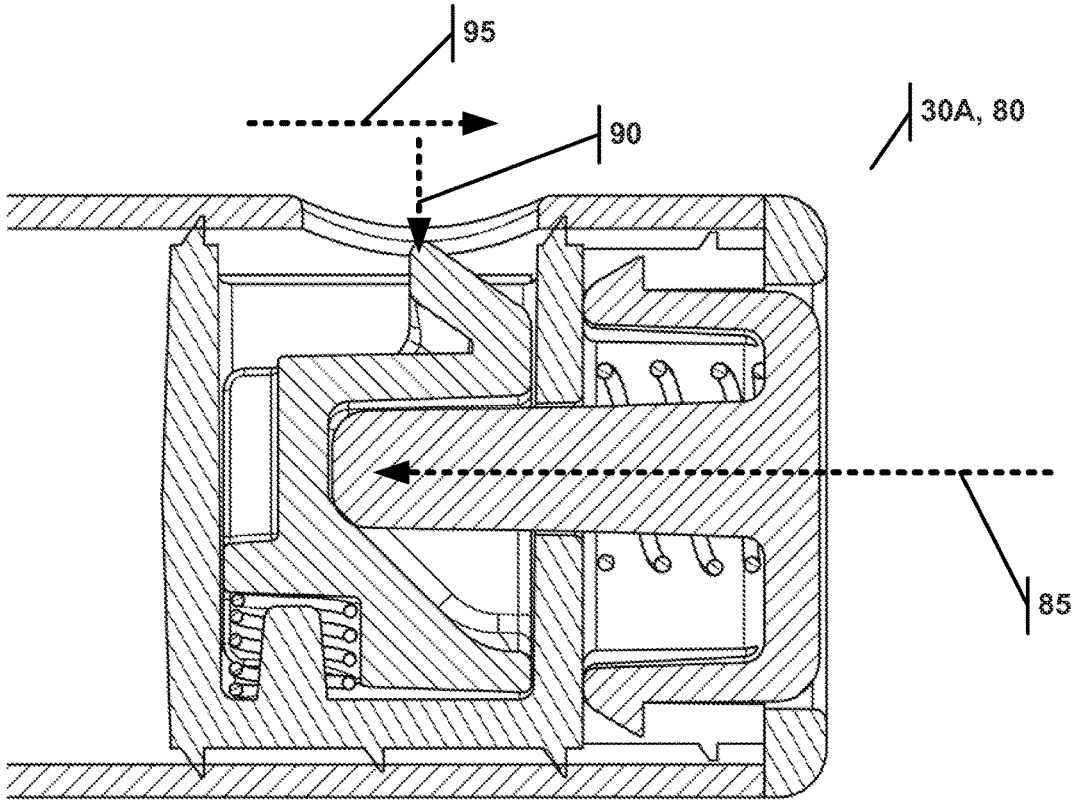
FIG. 3B is a cross-sectional view of a latch assembly of FIG. 3A in the unlocked configuration.
Figure 3C:
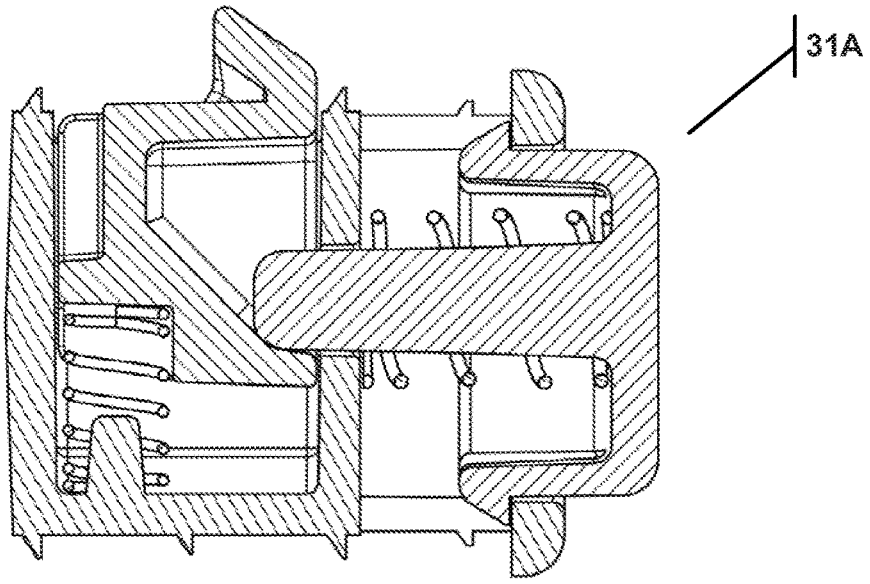
FIG. 3C is a cross-sectional view of the latch assembly cartridge shown in FIG. 3A.
Figure 3D:
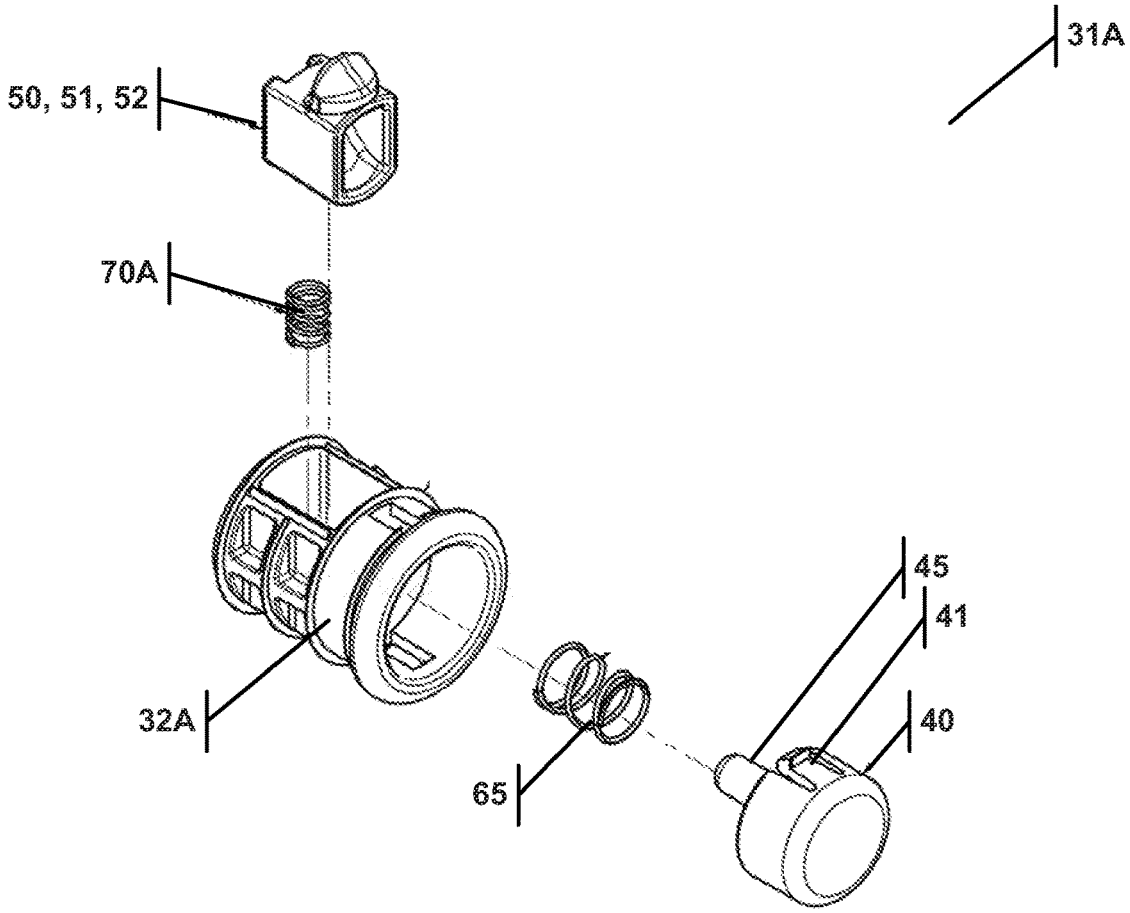
FIG. 3D is an exploded perspective view of the latch assembly cartridge shown in FIG. 3A.

In the unlocked configuration 80 shown in FIG. 3B, the button 40 is pressed, which compresses the button spring 65 and causes the button stem 45 to move along the latch ramp 55, which causes the latch 50 and the exposed portion of the latch 51 to retract into its compartment inside of the latch assembly cartridge housing 32A. This action also compresses the latch spring 70A. When the button 40 is released, the button-spring bias force 67 expands the button spring 65 and forces the button 40 to its original locked position resting against the button retention tabs 41. Releasing the button 40 also causes the latch-spring bias force 72 to expand the latch spring 70A to force the latch 50 upward to its original locked position resting against the tip of the button stem 45. This also causes the exposed portion of the latch 51 to extend through the roller axle opening 60.

The button spring 65 may be excluded, with the latch spring 70A providing enough force to push the latch ramp 55 against the button stem 45 to move the button 40 to its locked position after being pressed and released.

FIGS. 3E-H illustrate the latch assembly 30B. The latch assembly is comprised of a latch assembly cartridge 31B mounted to the open end of the roller axle 15. The latch assembly cartridge 31B is comprised of a latch assembly cartridge housing 32B, which houses a latch spring 70B and the exposed portion of the latch 51. The latch spring 70B may be made out of spring steel, other metal, flexible plastic, or the like. The latch assembly housing 32B and the exposed portion of the latch 51 may be made of plastic, metal, fiberglass, wood, or the like. In FIGS. 3E-3H, the latch assembly cartridge housing 32B has an opening that corresponds with the roller axle opening 60. The exposed portion of the latch 51 passes through both the latch assembly cartridge housing 32B opening as well as the roller axle opening 60 which helps to lock the latch assembly cartridge housing 32B in place in the roller axle 15. The latch assembly cartridge housing 32B also has a friction-fit into the open end of the roller axle 15. The cartridge housing may be fastened to the roller axle 15 by fasteners, adhesive, or the like.

The latch spring 70B may be a torsion spring that is directly connected to the exposed portion of the latch 51 on one end, and contacts the opposite inner wall of the roller axle 15 on the other end. Alternatively, the latch spring 70B is a compression spring. The latch spring 70B applies an upward latch-spring bias force 72 to the exposed portion of the latch 51.

Figure 3E:
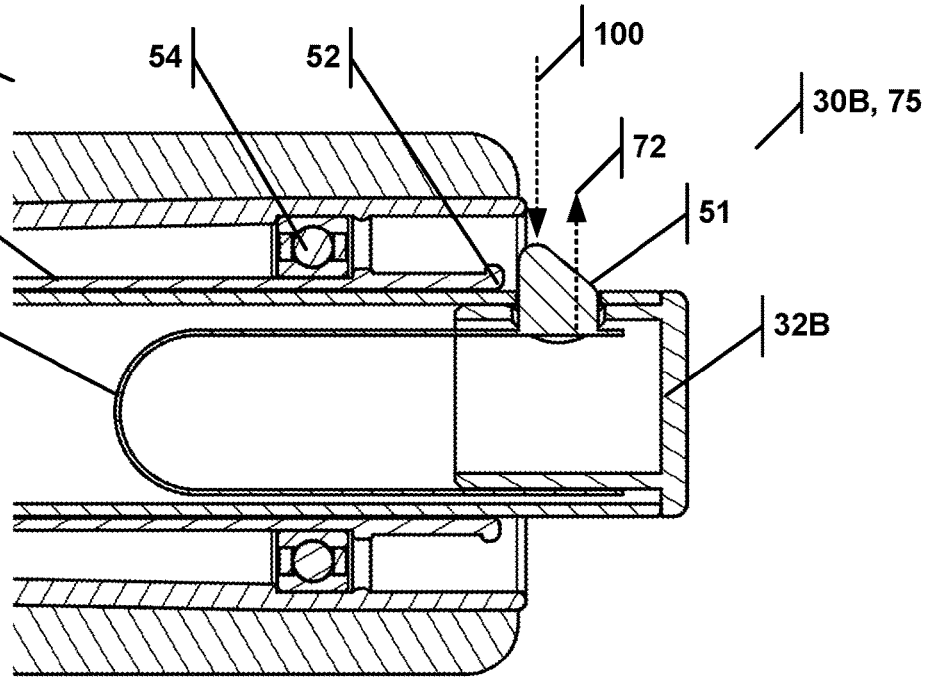
FIG. 3E is a cross-sectional view of an alternate latch assembly in the locked configuration.

In the locked configuration 75 shown in FIG. 3E, the exposed portion of the latch 51 extends upward outside of the latch assembly cartridge housing 32B and through the roller axle opening 60.

Figure 3F:
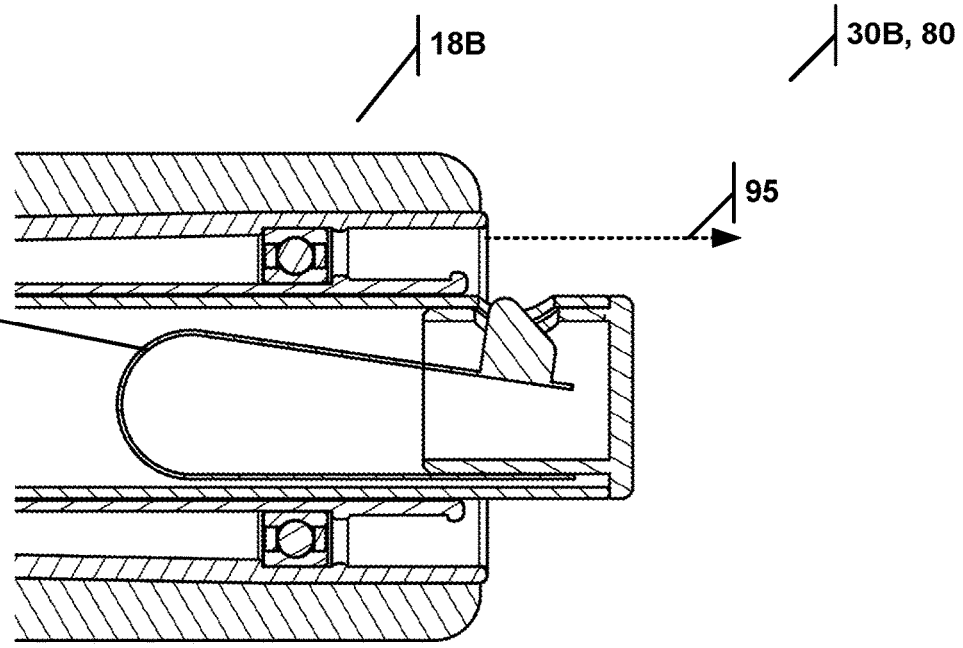
FIG. 3F is a cross-sectional view of the latch assembly of FIG. 3E in the unlocked configuration.
Figure 3G:
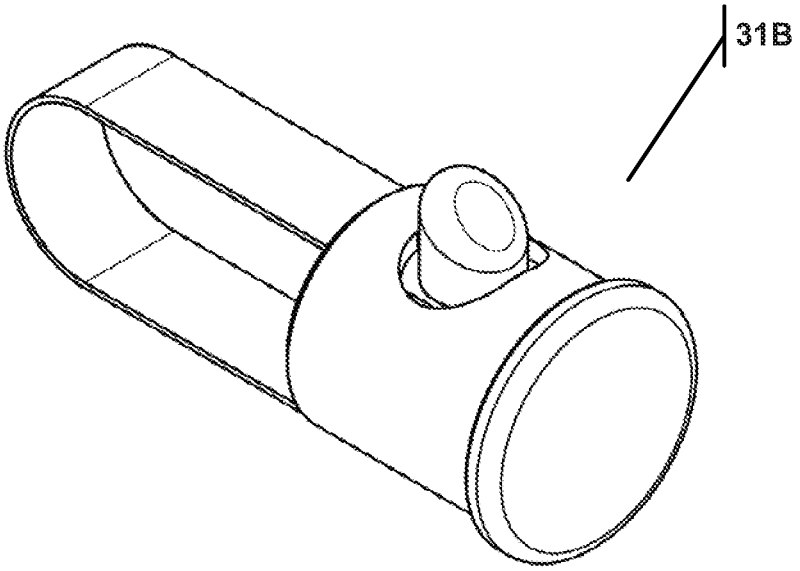
FIG. 3G is a perspective view of the latch assembly cartridge shown in FIG. 3E.
Figure 3H:
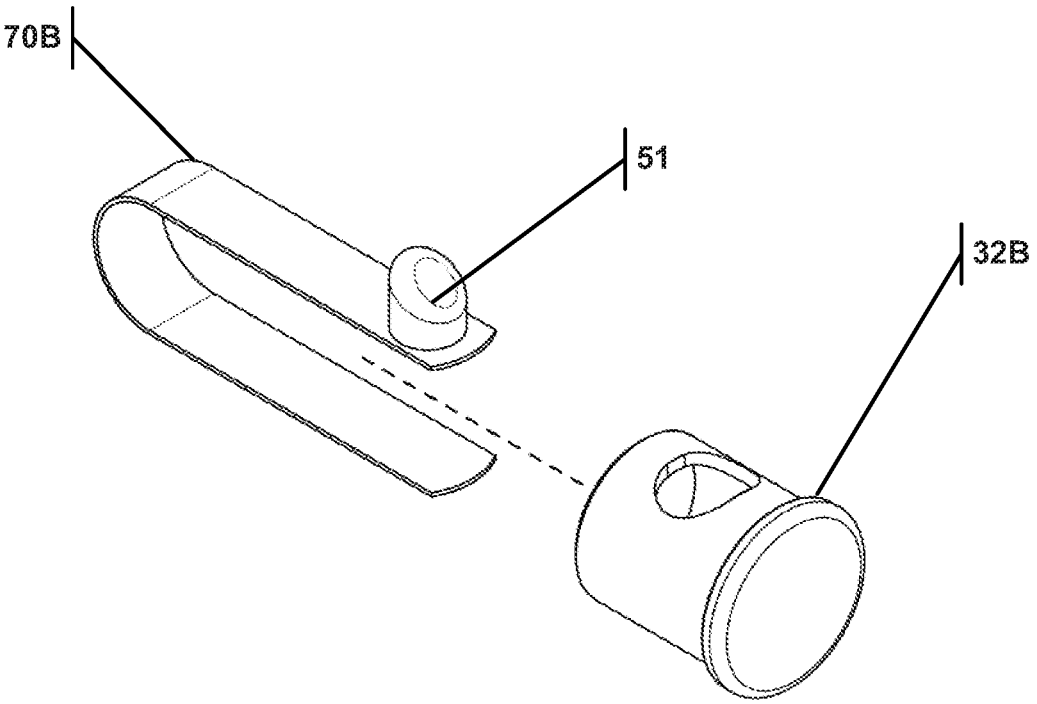
FIG. 3H is an exploded perspective view of the latch assembly cartridge shown in FIG. 3E.

In the unlocked configuration 80 shown in FIG. 3F, a user presses down 100 on the top portion of the exposed portion of the latch 51, which causes the latch spring 70B to compress. This causes the exposed portion of the latch 51 to retract into its compartment inside of the latch assembly cartridge housing 32B. When the user ceases to press down on the exposed portion of the latch 51, the latch-spring bias force 72 expands the latch spring 70B to force the exposed portion of the latch 51 to extend through the roller axle opening 60.

In another embodiment, the roller axle 15 may not have any roller axle openings 60, and the exposed portion of the latch 51 does not pass through the roller axle 15, but instead protrudes above the surface of the roller axle 15 beyond the open end of the roller axle 15. Alternatively, the roller axle 15 may have more than one roller axle opening, and the latch assembly 30A, 30B may have more than one latch 50 and more than one exposed portion of the latch 51.

Figure 4A:
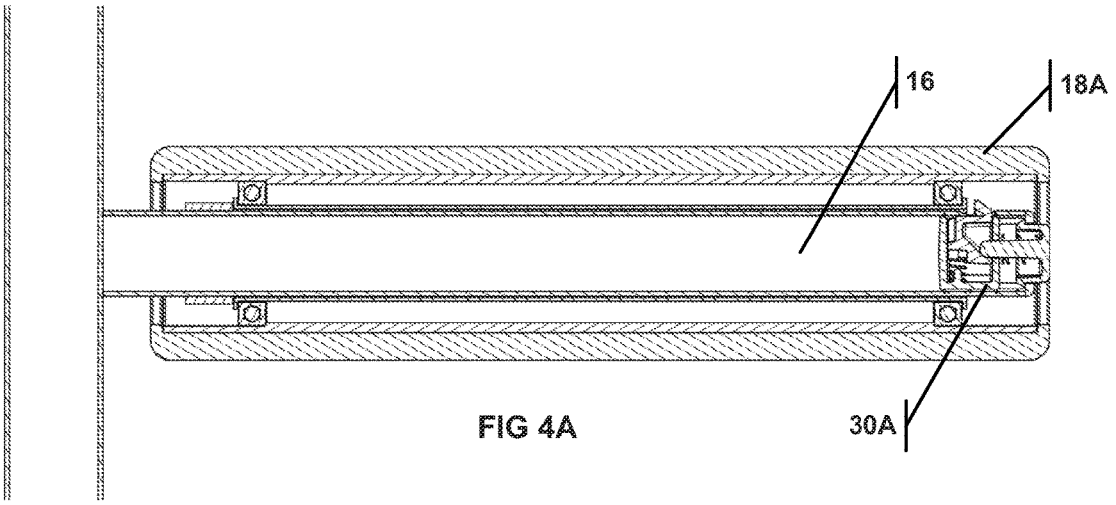
FIG. 4A is a cross-sectional view of the axle assembly with a roller assembly of FIG. 2A mounted thereto, with the latch assembly of FIG. 3A.

FIGS. 4A-5B illustrate embodiments of a roller assembly 18A, 18B, 18C removably mounted to a roller axle 15. FIGS. 4A, 5A show an embodiment that includes the roller assembly 18A embodiment from FIGS. 2A, 2D removably mounted a roller axle assembly 16 that includes the latch assembly 30A and latch assembly cartridge 31A embodiments from FIGS. 3A-3D. In this embodiment, the flange on each end of the inner tube 53 acts as the latch catch 52. The steep side of the exposed portion of the latch 51 prevents the latch catch 52 from moving past the latch in one direction while it is in the locked configuration 75. This prevents the roller assembly 18A from being removed from the roller axle assembly 16. However, if the roller axle assembly 16 does not presently have a roller assembly 18A mounted to it, then a user can install a new roller assembly 18A onto the roller axle 15.

A user installs a new roller assembly 18A by grasping the roller body 20 or roller foam 25 with one hand, and then guiding the inner tube 53 onto the open end of the roller axle 15 toward the sloped side of the exposed portion of the latch 51. The installation or mounting procedure is shown in FIGS. 6A-6D. As the latch catch 52 of the inner tube 53 contacts the sloped slide of the exposed portion of the latch 51, it will force the latch 50 to move downward and compress the latch spring 70A. As the inner tube 53 continues to slide onto the roller axle 15, its inner wall will continue to hold the exposed portion of the latch 51 down, allowing the entire roller assembly 18A to slide onto the roller axle 15 and past the latch 50 until the first edge of the inner tube 53 contacts the roller stop 54A. When the opposite edge of the inner tube 53 passes the exposed portion of the latch 51, the latch-spring bias force 72 will force the latch 50 to move upwards, which will cause the exposed portion of the latch 51 to extend up through the roller axle opening 60. Since the steep side of the exposed portion of the latch 51 is now facing the latch catch 52, the roller assembly 18A is not able to slide past the exposed portion of the latch 51 in the opposite direction to remove the roller assembly 18A from the roller axle 15. The latch assembly 30A is now in the locked configuration 75. The inner tube 53 is locked onto the roller axle 15 between the exposed portion of the latch 51 on one side and the roller stop 54A on the opposite side. This allows the roller body 20 with roller foam 25 to rotate freely about the inner tube 53 using the bearings 54 without any rubbing against the roller axle 15, the exposed portion of the latch 51, the roller stop 54A, or the roller device structure 12. Using this method, a user may install two roller assemblies 18A at the same time, one with each hand.

Figure 5B:
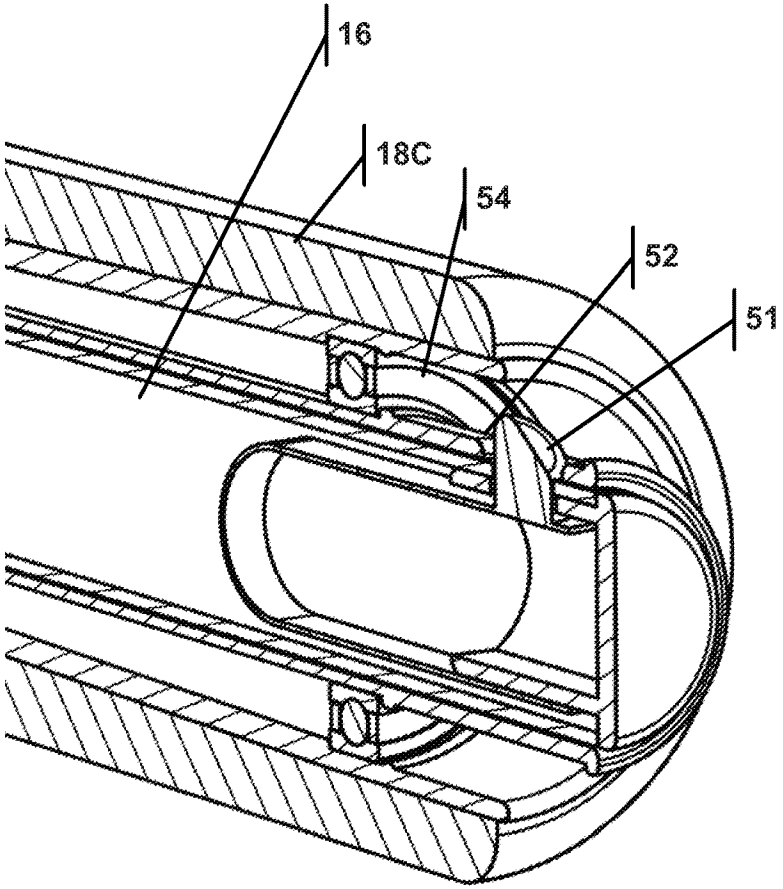
FIG. 5B is a cross-sectional perspective view of the roller assembly mounted on the roller axle, and the latch assembly of FIG. 3E in the locked configuration.
Figure 5A:
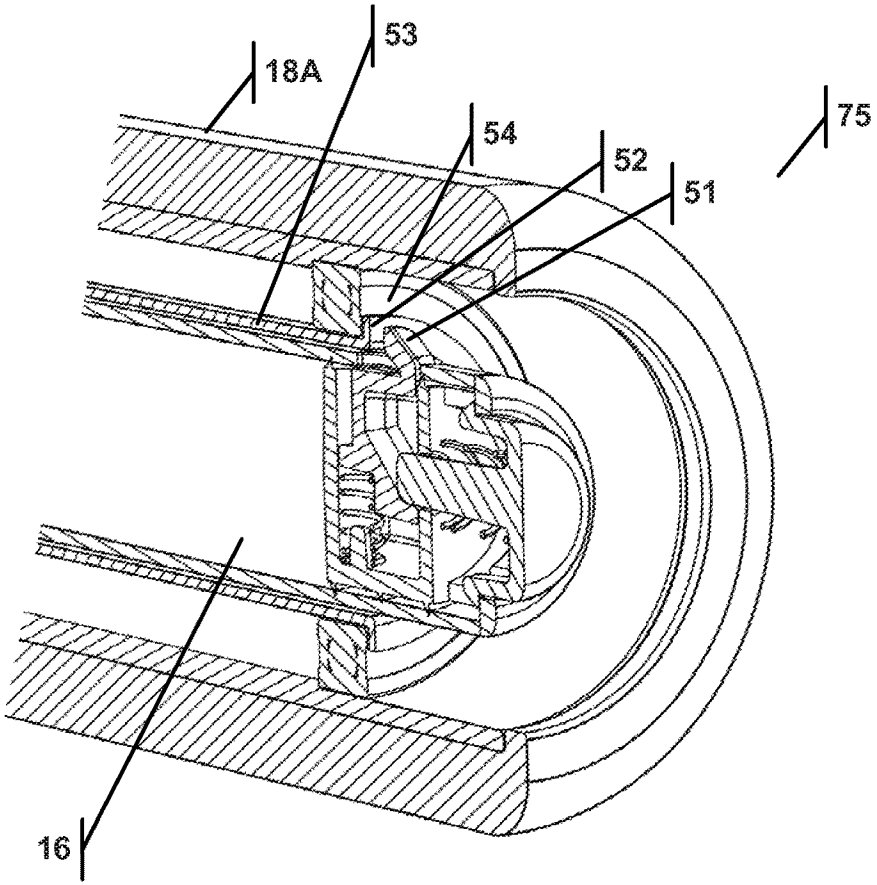
FIG. 5A is a cross-sectional perspective view of the roller assembly mounted on the roller axle, and the latch assembly of FIG. 3A in the locked configuration.
Figure 6A:
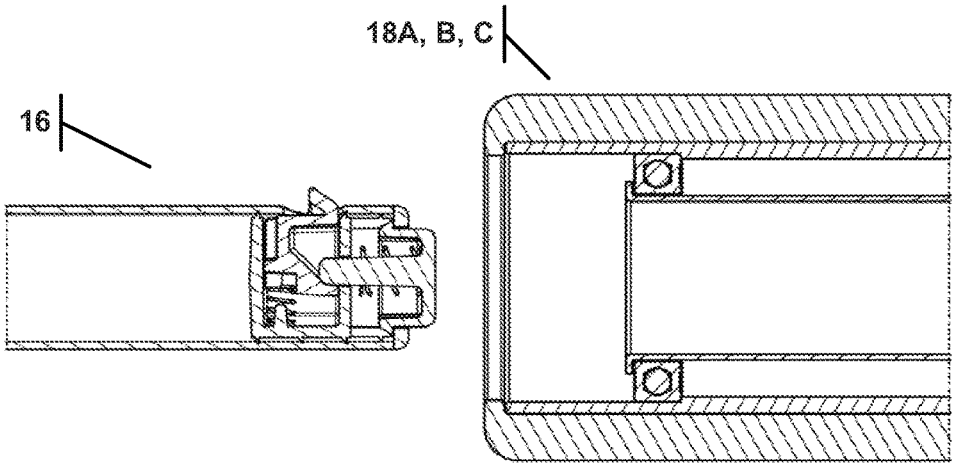
FIG. 6A illustrates the mounting of the roller assembly to the axle assembly.
Figure 6B:
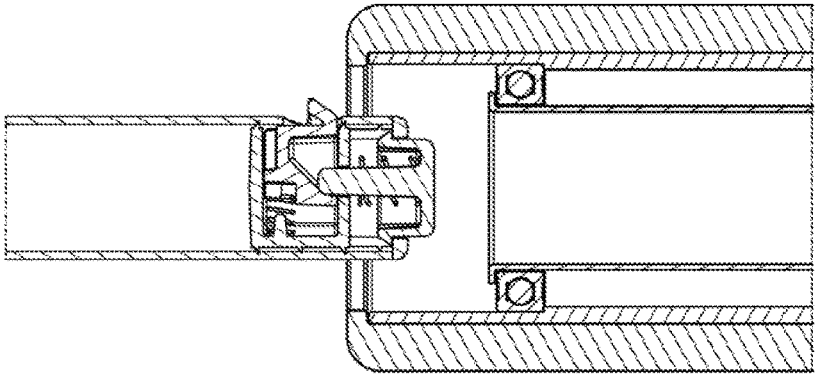
FIG. 6B illustrates the mounting of the roller assembly to the axle assembly.
Figure 6C:
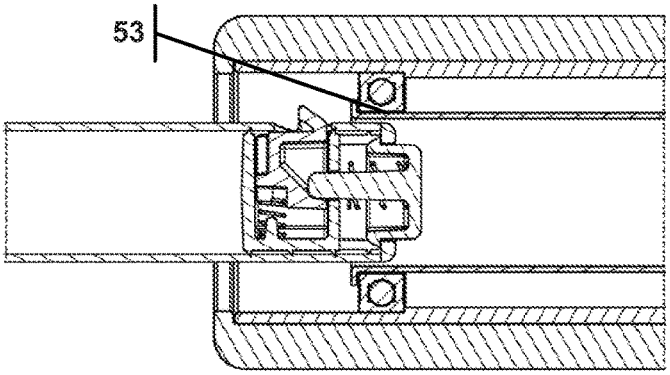
FIG. 6C illustrates the mounting of the roller assembly to the axle assembly.
Figure 6D:
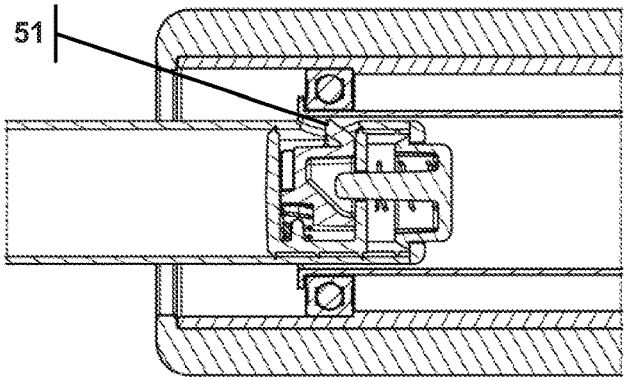
FIG. 6D illustrates the mounting of the roller assembly to the axle assembly.

In order to remove the roller assembly 18A from the roller axle assembly 16, as shown in the embodiment in FIGS. 4A and 5A, a user may grasp the roller assembly 18A with one hand in such a way that their thumb extends past the end of the roller assembly 18A. They can then place their finger/thumb onto the button 40 of the latch assembly 30A while still grasping the roller foam 25 of the roller assembly 18A with the same hand. They would then press down on the button 40, which will cause the latch 50 to retract, causing the exposed portion of the latch 51 to retract, putting the latch assembly 30A into the unlocked configuration 80. This allows the latch catch 52 of the roller assembly 18A to pass by the exposed portion of the latch 51. The user may then separate the roller assembly 18A from the roller axle 15 by pulling the roller towards the open end of the roller axle 15 with the same single hand that grasped the roller foam 25 and released the latch 50. In this way, a user may release and remove two roller assemblies 18A at the same time, one with each hand.

Figure 4B:
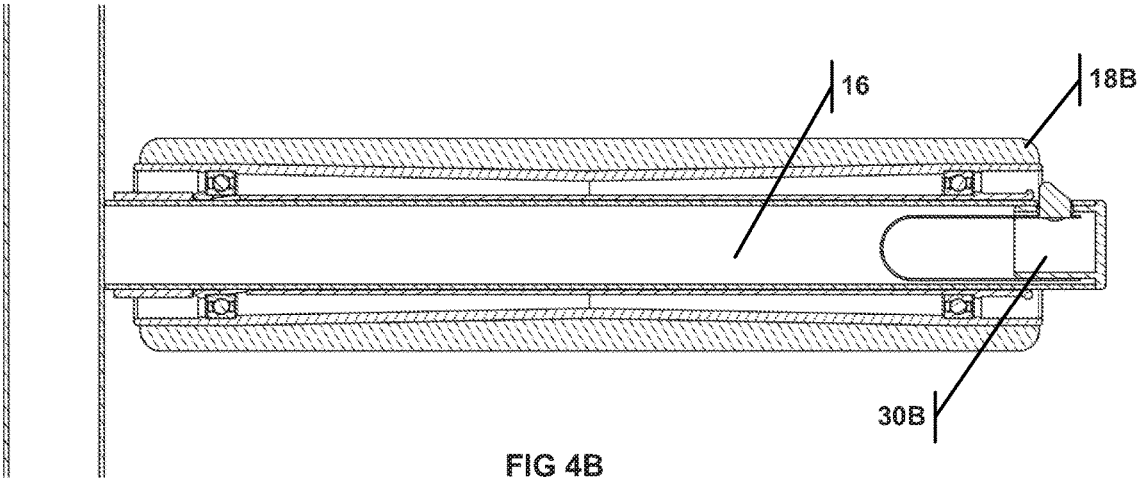
FIG. 4B is a cross-sectional view of the axle assembly with a roller assembly of FIG. 2B mounted thereto, with the latch assembly of FIG. 3E.

Turning now to the embodiment shown in FIG. 4B, this embodiment includes the roller assembly 18B embodiment from FIGS. 2B and 2E removably mounted to a roller axle assembly 16 that includes the latch assembly 30B and latch assembly cartridge 31B embodiments from FIGS. 3E-3H. In this embodiment the edge of the extended collar 53B on the inner tube 53 acts as the latch catch 52. The steep side of the exposed portion of the latch 51 prevents the latch catch 52 from moving past the latch in one direction while it is in the locked configuration 75. This prevents the roller assembly 18B from being removed from the roller axle assembly 16. However, if the roller axle assembly 16 does not presently have a roller assembly 18B mounted to it, then a user can install a new roller assembly 18B onto the roller axle 15.

A user installs a new roller assembly 18B by grasping the roller body 20 or roller foam 25 with one hand, and then guiding the inner tube 53 onto the open end of the roller axle 15 toward the sloped side of the exposed portion of the latch 51. As the edge of the inner tube 53 contacts the sloped slide of the exposed portion of the latch 51, it will force the exposed portion of the latch 51 to move downward and compress the latch spring 70B. As the inner tube 53 continues to slide onto the roller axle 15, its inner wall will continue to hold the exposed portion of the latch 51 down, allowing the entire roller assembly 18B to slide onto the roller axle 15 and past the exposed portion of the latch 51. When the opposite edge of the inner tube 53, which includes the extended collar 53B, passes the exposed portion of the latch 51, then the latch-spring bias force 72 will force the exposed portion of the latch 51 to move upwards and extend up through the roller axle opening 60. Since the steep side of the exposed portion of the latch 51 is now facing the latch catch 52, the roller assembly 18B is not able to slide past the exposed portion of the latch 51 in the opposite direction to remove the roller assembly 18B from the roller axle 15 while the latch assembly 30B is in the locked configuration 75.

In order to remove the roller assembly 18B from the roller axle assembly 16, as shown in the embodiment in FIG. 4B, a user may grasp the roller assembly 18B with one hand in such a way that their finger/thumb extends past the end of the roller assembly 18A. They can then place their finger/thumb onto the top of the exposed portion of the latch 51 of latch assembly 30B while still grasping the roller foam 25 of the roller assembly 18B with the same hand. They would then press down on the exposed portion of the latch 51, causing it to retract. This allows the latch catch 52 of the roller assembly 18B to pass by the exposed portion of the latch 51. The user may then separate the roller assembly 18B from the roller axle 15 by pulling the roller towards the open end of the roller axle 15 with the same single hand that grasped the roller foam 25 and released the latch 50. In this way, a user may release and remove two roller assemblies 18B at the same time, one with each hand.

Figure 4C:
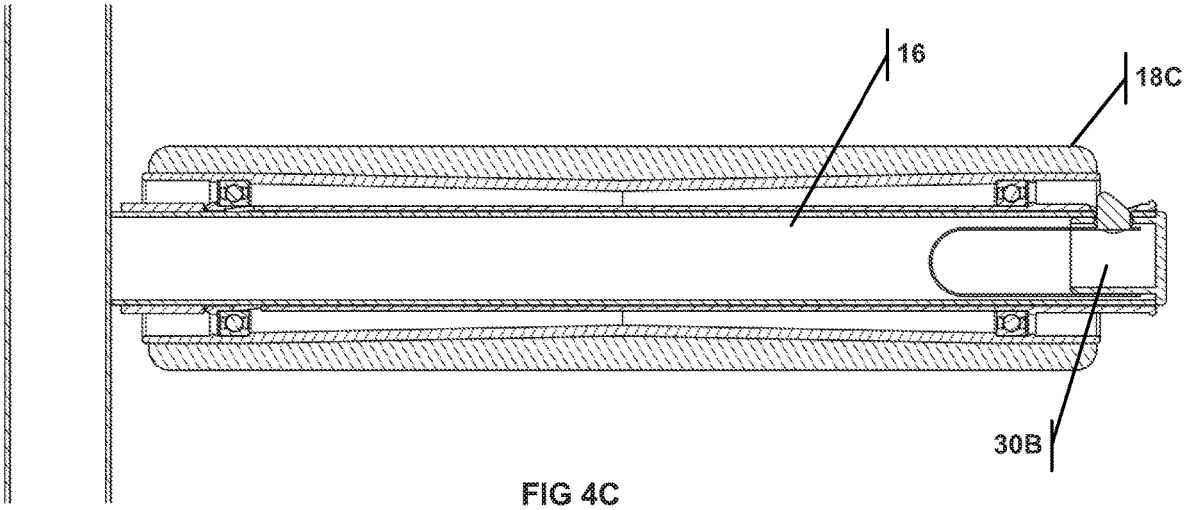
FIG. 4C is a cross-sectional view of the axle assembly with a roller assembly of FIG. 2C mounted thereto, with the latch assembly of FIG. 3E.

Turning now to the embodiment shown in FIGS. 4C and 5B, this embodiment includes the roller assembly 18C embodiment from FIGS. 2C and 2F removably mounted to a roller axle assembly 16 that includes the latch assembly 30B and latch assembly cartridge 31B embodiments from FIGS. 3E-3H. In this embodiment the edge of the extended collar hole 56 in the extended collar 53C acts as the latch catch 52. The steep side of the exposed portion of the latch 51 prevents the latch catch 52 from moving past the latch in one direction while it is in the locked configuration 75. This prevents the roller assembly 18C from being removed from the roller axle assembly 16. However, if the roller axle assembly 16 does not presently have a roller assembly 18C mounted to it, then a user can install a new roller assembly 18C onto the roller axle 15.

A user installs a new roller assembly 18C by grasping the roller body 20 or roller foam 25 or extended collar 53C with one hand, and then guiding the inner tube 53 onto the open end of the roller axle 15 toward the sloped side of the exposed portion of the latch 51. As the edge of the inner tube 53 contacts the sloped slide of the exposed portion of the latch 51, it will force the exposed portion of the latch 51 to move downward and compress the latch spring 70B. As the inner tube 53 continues to slide onto the roller axle 15, its inner wall will continue to hold the exposed portion of the latch 51 down allowing the entire roller assembly 18C to slide onto the roller axle 15. When the first edge of the inner tube 53 contacts the roller stop 54A, then the user twists the extended collar 53C until the extended collar hole 56 is aligned with the exposed portion of the latch 51. When they are aligned, the latch-spring bias force 72 will force the exposed portion of the latch 51 to move upwards and extend up through the roller axle opening 60 and through the extended collar hole 56. Since the steep side of the exposed portion of the latch 51 is now facing the latch catch 52, the roller assembly 18C is not able to slide past the exposed portion of the latch 51 in the opposite direction to remove the roller assembly 18C from the roller axle 15 while the latch assembly 30B is in the locked configuration 75.

In order to remove the roller assembly 18C from the roller axle assembly 16, as shown in the embodiment in FIGS. 4C and 5B, a user may grasp the extended collar 53C with one hand in such a way that their finger/thumb rests on the exposed portion of the latch 51, while their fingers wrap around the outside of the extended collar 53C. They would then press down on the exposed portion of the latch 51 causing it to retract. This allows the latch catch 52 of the roller assembly 18C to pass by the exposed portion of the latch 51 in order to separate the roller assembly 18C from the roller axle 15. The user simply pulls on the extended collar 53C that they are already grasping in their hand in order to remove the roller assembly 18C from the roller axle 15. In this way, a user may release and remove two roller assemblies 18C at the same time, one with each hand.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend the following claims "and the embodiments in the specification to be strictly coextensive." *Phillips* v. *AHW Corp.,* 415 F.3d 1303, 1323 (Fed. Cir. 2005) (en banc).

The invention claimed is:

1. A roller system comprising:

a roller axle with a longitudinal axis, the roller axle having an opening and housing at least a portion of a latch assembly, the latch assembly comprising:

a button with a button stem, the button constructed to move parallel to the longitudinal axis; and a latch comprising a latch ramp that contacts the button stem, the latch constructed to move orthogonal to the longitudinal axis;

a roller assembly constructed to removably fit around the roller axle, the roller assembly comprising:

a latch catch;

an inner tube concentric with a roller body; and a bearing in between the inner tube and the roller body;

wherein the roller system has two configurations:

a locked configuration, wherein the latch has an exposed portion configured to exit the opening and to prevent the latch catch from passing over the opening, thereby locking the roller assembly onto the roller axle; and an unlocked configuration, wherein the button is configured to move parallel to the longitudinal axis, causing the button stem to travel along the latch ramp and to retract the exposed portion of the latch, thereby allowing the latch catch to pass over the opening to separate the roller assembly from the roller axle;

wherein the inner tube is constructed to turn independently of the roller axle when in the locked configuration.

2. The roller system of claim 1, wherein the exposed portion of the latch has a ramp shape, such that when the roller assembly is mounted to the roller axle, the roller assembly is configured to travel along the ramp shape and to retract the exposed portion of the latch.

3. The roller system of claim 1, wherein the roller axle comprises a roller stop.

4. The roller system of claim 1, wherein the latch assembly is a latch assembly cartridge.

5. The roller system of claim 1, wherein the roller assembly comprises an extended collar with a distal and a proximal edge, and the latch catch is on the proximal edge of the extended collar.

6. The roller system of claim 1, wherein the roller assembly comprises a foam outer covering.

7. A roller system comprising:

a roller axle with a longitudinal axis, the roller axle housing at least a portion of a latch assembly, the latch assembly comprising:

a latch comprising an exposed portion constructed to move orthogonal to the longitudinal axis; and a roller assembly constructed to removably fit around the roller axle, the roller assembly comprising:

a latch catch;

an inner tube concentric with a roller body; and a bearing in between the inner tube and the roller body;

wherein the roller system has two configurations:

a locked configuration, wherein the exposed portion of the latch is configured to obstruct the latch catch from sliding, thereby locking the roller assembly onto the roller axle; and an unlocked configuration, wherein the exposed portion of the latch is configured to move towards the longitudinal axis, thereby allowing the latch catch to slide past the exposed portion of the latch to separate the roller assembly from the roller axle;

wherein the inner tube is constructed to turn independently of the roller axle when in the locked configuration.

8. The roller system of claim 7, wherein the latch assembly comprises a latch spring biased to maintain the exposed portion of the latch exposed.

9. The roller system of claim 7, wherein the exposed portion of the latch has a ramp shape, such that when the roller assembly is mounted to the roller axle, the roller assembly is configured to travel along the ramp shape and retract the exposed portion of the latch.

10. The roller system of claim 7, wherein the roller axle comprises a roller stop.

11. The roller system of claim 7, wherein the latch assembly is a latch assembly cartridge.

12. The roller system of claim 7, wherein the roller axle has an opening, and the exposed portion of the latch is configured to travel through the opening.

13. The roller system of claim 7, wherein the roller assembly comprises an extended collar with a distal and a proximal edge, and the latch catch is on the proximal edge of the extended collar.

14. The roller system of claim 7, wherein the latch assembly comprises a button with a button stem, the button constructed to move parallel to the longitudinal axis, and the latch further comprises a latch ramp that contacts the button stem, and wherein during the unlocked configuration, the button is configured to move parallel to the longitudinal axis causing, the button stem to travel along the latch ramp and to retract the exposed portion of the latch.

15. The roller system of claim 14, where the latch assembly comprises a button spring biased to maintain the button in the locked configuration in an absence of an actuation force on the button.

16. The roller system of claim 7, wherein the roller assembly comprises a foam outer covering.

17. The roller system of claim 1, wherein the latch catch is constructed to completely rotate about the longitudinal axis when in the locked configuration.

18. The roller system of claim 7, wherein the latch catch is constructed to completely rotate about the longitudinal axis when in the locked configuration.

* * * * *